United States Patent [19]

Pennings et al.

[11] Patent Number: 5,068,073

[45] Date of Patent: Nov. 26, 1991

[54] METHOD OF MANUFACTURING POLYETHYLENE FIBERS BY HIGH SPEED SPINNING OF ULTRA-HIGH-MOLECULAR-WEIGHT POLYETHYLENE

[75] Inventors: Albert J. Pennings, Norg; Mees Roukema, Groningen, both of Netherlands

[73] Assignee: Akzo N.V., Netherlands

[21] Appl. No.: 552,135

[22] Filed: Jul. 13, 1990

[30] Foreign Application Priority Data

Jul. 13, 1989 [DE] Fed. Rep. of Germany ..... 3923139

[51] Int. Cl.[5] ..... D01F 6/04

[52] U.S. Cl. ..... 264/205; 264/210.8; 264/211.15; 264/211.17

[58] Field of Search ..... 264/12, 13, 14, 156, 264/167, 205, 210.2, 210.8, 211.14, 290.5, 517, 518

[56] References Cited

U.S. PATENT DOCUMENTS

| | | | |
|---|---|---|---|
| 2,335,922 | 12/1943 | Dreyfus | 264/205 |
| 2,588,584 | 3/1952 | Small | 264/205 |
| 3,608,041 | 9/1971 | Santangelo | 264/205 |
| 4,344,908 | 8/1982 | Smith et al. | 264/290.5 |
| 4,411,854 | 10/1983 | Maurer et al. | 264/205 |
| 4,422,993 | 12/1983 | Smith et al. | 264/205 |
| 4,436,689 | 3/1984 | Smith et al. | 264/205 |
| 4,551,296 | 11/1985 | Kavesh et al. | 264/210.8 |
| 4,617,233 | 10/1986 | Ohta et al. | 264/210.8 |

*Primary Examiner*—Hubert C. Lorin

*Attorney, Agent, or Firm*—Oliff & Berridge

[57] ABSTRACT

An approximately 1 to 6 wt. % solution manufactured from polyethylene with a molecular weight $M_w$ of at least one million and a solvent is extruded into a spinning duct at an extrusion temperature $T_E$=180° to 250° C. at an extrusion rate $V_E$=5 to 150 m/min. The duct is kept at a temperature of 100° to 250° C. by means of a heating device below the jet outlet area. The fibers are drawn off at a rate $V_w$ of at least 500 m/min, preferably 1500 to 4000 m/min, and freed of the solvent without further stretching. The fibers obtained are especially well suited for manufacturing industrial yarns, protective clothing, bulletproof vests, ropes, and parachutes. In the form of staple fibers, they are suitable for reinforcing various plastics.

12 Claims, 1 Drawing Sheet

METHOD OF MANUFACTURING POLYETHYLENE FIBERS BY HIGH SPEED SPINNING OF ULTRA-HIGH-MOLECULAR-WEIGHT POLYETHYLENE

BACKGROUND

The invention relates to a method of manufacturing polyethylene fibers by high-speed spinning of solutions of ultra-high-molecular-weight polyethylene, thereby producing fibers which are quite suitable for use as industrial yarns, for reinforcing plastics in general, and the like, because of their good strengths and their high modulus.

It is known that fibers and industrial yarns can be made from a number of polymers such as regenerated cellulose, polyester, polyamides, and the like. In all of these methods, the goal is to produce fibers with high strengths, high moduli, especially high initial moduli, and elongation at break which is as small as possible. In addition, the goal is to work at the highest possible production speeds using the simplest procedures possible.

There have been many attempts to produce yarns of this kind from polyethylene which, because of its chemical structure has a number of advantages over polymers like those produced by polycondensation. For example, there is no danger of hydrolysis, which is frequently observed in the ester bonds or amide bonds of polyesters and polyamides. In addition, as a synthetic material that can be manufactured in practically unlimited quantities, polyethylene is less prone to fluctuations in supply and demand, as is the case for cellulose, quite apart from the fact that the supply of raw materials for cellulose is becoming increasingly endangered by the decimation of the forests.

The simplest procedure involves making polyethylene fibers by the melt-spinning process. However, there are limits on melt-spinning polyethylene because, as the molecular weights, which are important for high strength and moduli, increase, the viscosity of the melts increases to the point where they become difficult to spin. The spinning temperature cannot be increased arbitrarily because there is a risk of the polyethylene decomposing at temperatures above approximately 240° C. As molecular weights increase, the elasticity of the polymer melts increases as well, and this can lead to problems, especially at higher extrusion speeds.

Efforts have also been made to overcome these disadvantages by spinning polyethylene solutions into fibers. However, in these methods as well, similar problems arise because the viscosity and elasticity increase considerably with the molecular weight of the dissolved polymer, even in solutions.

In Dutch Disclosure Document 79/04990, a method for manufacturing polyethylene fibers with high strength and high modulus is described, in which process, as is especially clear from the examples, solutions of relatively low concentrations are used. In order to obtain satisfactory mechanical properties, it is necessary to stretch the fibers while hot after spinning, winding, and extracting, thus reducing the productivity of the method.

In "Polymer Bulletin," Volume 16, pages 167–174, 1986, Pennings et al. describe how ultra-high-molecular-weight polyethylene can be spun under various conditions. However, in order for the polyethylene fibers to exhibit usable mechanical properties, the fibers, as in the method described in Dutch Disclosure Document 79/04990, must be stretched, with the fibers also being extracted before stretching.

Although many methods are known for producing polyethylene fibers by spinning ultra-high-molecular-weight polyethylene, there is still a need for improved methods which in particular ensure increased productivity and in which it is not necessary to follow spinning and winding by stretching to obtain usable mechanical properties.

SUMMARY OF THE INVENTION

This invention relates to a process of manufacturing polyethylene fibers from an approximately 1 to 6 wt. % solution of polyethylene with a molecular weight of $M_w$ of at least one million and a solvent. This solution is extruded into a spinning duct at an extrusion temperature $T_E = 180°$ to 250° C. at an extrusion rate Vr = 5 to 150 m/min, said duct being kept at a temperature of 100° to 250° C. by means of a heating device below the jet outlet area. The fibers are drawn off at a rate $V_w$ of at least 500 m/min, preferably 1500/4000 m/min, and freed of the solvent without further stretching.

A goal of the invention is to provide a process for high-speed spinning of ultra-high-molecular-weight polyethylene which ensures high productivity, works without stretching the spun fibers, and produces in simple fashion polyethylene fibers that exhibit good mechanical properties, especially high strength and high modulus, and which are suitable for use as industrial yarns, as reinforcing material for plastics, etc.

DESCRIPTION OF PREFERRED EMBODIMENTS

Figure 1:
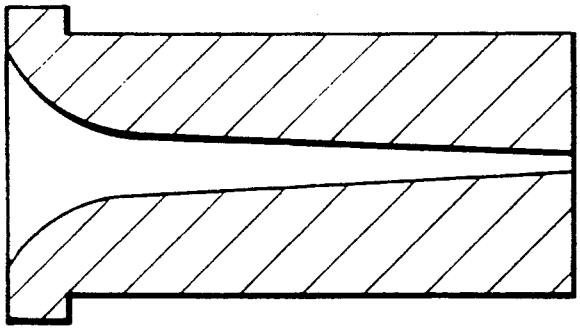
FIG. 1 shows a cross-section of the preferred jet opening.

This goal is achieved by a method for manufacturing polyethylene fibers by high-speed spinning of solutions of ultra-high-molecular-weight polyethylene, characterized by preparing an approximately 1 to 6 wt. % solution from polyethylene with a molecular weight $M_w \geqq 1 \times 10^6$ and a solvent, and then extruding the solution at an extrusion temperature $T_E = 180°$–250° C. and an extrusion rate $V_E = 5$ to 150 m/min into a spinning duct through spinnerets with jet openings whose cross section decreases toward the jet outlet area, said duct being kept below the jet outlet area at a temperature of 100° to 250° C. by means of a heater, by a gas being blown onto the fibers below the heating zone, the fibers being drawn off at a speed $V_w \geqq 500$ m/min, and freed of the solvent without further stretching.

Preferably, the molecular weight $M_w \geqq 3.5 \times 10^6$.

In an especially advantageous embodiment of the method according to the invention, the molecular non-uniformity (U) of the polymer, expressed as $$U = \frac{M_w}{M_n}$$

is $\leqq 5$, preferably $\leqq 3$.

Preferably the temperature below the jet outlet area is set to 150° to 190° C. It is advantageous to work at a pulloff speed of at least 1000 m/min. Pulloff speeds of 1500 to 4000 m/min are very advantageous.

To employ the process according to the invention, spinnerets with jet openings are used whose cross sections decrease in the extrusion direction. Thus, spinnerets with jet openings are used whose cross-sectional pattern could be described by the terms "trumpet-shaped" or "funnel-shaped" or "pseudohyperbolic." One such favorable pseudohyperbolic cross-sectional shape is shown in FIG. 1.

In the following, the term "pseudohyperbolic cross-sectional shape" will be understood to mean one that approaches a hyperbolic curve but can have more or less divergence at both the beginning and the end.

Preferably, a solvent is used to manufacture the solutions such that the solution has a viscosity of 1 to 100 Pa/s at extrusion temperature. Paraffin oil is especially suitable for this purpose. The viscosity is measured at a speed gradient $D=1\ s^{-1}$.

A polyethylene which is as unbranched as possible is used to manufacture the solutions but this does not rule out the fact that branches might be present to a slight degree. Preferably, the polymer used is a polyethylene obtained by low-pressure polymerization. It is commercially available and is frequently referred to as HDPE (high-density polyethylene).

It is especially advantageous to use as the polymer a polyethylene which occurs fully or largely as a homopolymer. In certain cases, however, it is also possible to use a copolymer, for example, a copolymer constructed up to approximately 5 wt. % from monomers other than ethylene, such as propylene or butylene. Of course, copolymers may be used which contain larger or smaller quantities of a given monomer.

The polyethylene used to manufacture the polyethylene fibers according to the invention is a member of those types of polyethylene which are generally termed ultra-high-molecular-weight polyethylenes. These include polyethylenes that have a molecular weight $M_w$ of at least one million with $M_w$ referring to the weight average, which can be determined, for example, by the GPC method. $M_n$ is the numerical average, which can be determined, for example, by osmotic methods.

While it is also possible to use within the scope of the invention polyethylenes with an ordinary molecular weight distribution, which can be more or less broad, and have a non-uniformity of 20 for example, it is nevertheless advantageous to use a polyethylene that has as narrow as possible a molecular weight distribution whose non-uniformity value will also be as low as possible. The non-uniformity, which is defined by the ratio of the weight average of the molecular weight to the numerical average of the molecular weight $$U = \frac{M_w}{M_n}$$

preferably be $\leqq 5$, especially $\leqq 3$.

The non-uniformity of the polymer used can be controlled by the method of manufacture; of course, it is also possible to obtain a polymer with a narrow molecular weight distribution from a polyethylene with a very wide molecular weight distribution, by fractionation.

The compounds used as solvents are those which are still sufficiently viscous at extrusion temperatures between 180° and 250° C., and possibly between 180° and 230° C., i e., viscosities of preferably at least 3–10 Pa/s, measured with $D=1\ s^{-1}$.

The polyethylene-solvent system should be selected so that the solution forms a gel when cooled to temperatures below the extrusion temperature. Preferably, the gel formation temperature should be 130° C. or less. It can also be below 70° C. The spinning solutions mentioned above are elastic. Dissolution of the polyethylene in the solvent preferably takes place at temperatures that correspond to the extrusion temperature. It is advantageous for dissolution to take place under an inert atmosphere, for example, under nitrogen. A stabilizer may be added to the solution. Paraffin oils are especially suitable as solvents. In addition, hydrocarbons such as cyclo-octane, paraxylol oil, decaline, or petroleum ether may be used. Within the scope of the invention, solutions with concentrations of approximately 1 to 6 wt. % may be used, preferably those with concentrations of 1 to 3 wt. %. However, concentrations of approximately 1 to 2 wt. % are most advantageous.

The term "extrusion rate" refers to the quantity of spinning fluid which leaves the jet per unit time per unit area of the jet outlet openings. It is expressed in $m^3/m^2$ x min or m/min.

The term "pulloff speed" refers to the linear velocity in m/min at Which the threads are pulled off at the lower end of the spinning duct. Since the threads are no longer subjected to further stretching after being pulled off, this pulloff speed generally corresponds to the winding speed.

The pulloff speeds that can be reached depend on the concentrations selected. In general, it may be said that the maximum pulloff speed decreases with increasing polyethylene concentration. However, it may be possible for problems to occur during spinning in the lower concentration range; these can be corrected by lowering the extrusion rate. The most appropriate combinations of extrusion rate, pulloff speed, and solution concentration may be determined by a few tests.

In general, the maximum attainable extrusion rate decreases with increasing polymer concentration.

Simple annular heating devices, for example, may be used as devices which bring the spinning duct below the spinneret to the required temperature. The length of the heating zone, depending on the size of the spinning machinery used, can vary between several centimeters, e.g., 4 cm, and 200 cm.

Below the heating zone, a gas is blown at the fibers to reduce the temperature. It is advantageous to use the blowing on the fibers to produce a gradient-type or staggered temperature curve so that downstream from the heating zone, in which a temperature of 160° C. prevails, for example, there is first a zone in which the temperature drops only by 10° C., for example to about 150° C., which is then followed by another zone in which the temperature drops to 110° C., for example, and this in turn is followed by yet another zone in which cooling to temperatures below 50° C. takes place by using a gas at room temperature, so that the fibers are sufficiently cooled when they reach the pulling element. Temperature gradations can also be created by using one or more heating devices by which temperature gradations may be adjusted.

The cross-sectional shape of the spinning openings is of great importance to the method according to the invention. The spinning openings on the side on which the spinning material enters the jet openings should have an expanded opening; in other words, the cross section of the jet openings should decrease toward the outlet side. Jet openings that have a pseudohyperbolic shape are especially suitable. The term "pseudohyperbolic" refers to a curve which approaches a hyperbolic curve and can have divergences from an exactly hyperbolic curve both in the more sharply curved area and in the more linear area. FIG. 1 shows such a design schematically.

However, jets with jet openings can also be used which initially have a funnel-shaped opening part, which can also be trumpet shaped or even conical, which then makes an abrupt transition, or a smooth one, to a conical curve in which the cone has a more pointed aperture angle than the cone or the parabola of the inlet part. It is possible to design the latter part of the jet opening with a constant cross section.

It was especially surprising to discover that it is possible to use the method according to the invention to process ultra-high-molecular-weight polyethylene into fibers with good mechanical properties such as high modulus and high breaking strength. The method according to the invention is especially advantageous with regard to known methods by virtue of the fact that it is a so-called single-stage process, i.e., it works without the afterstretching that was formerly required. This makes the process especially economical and allows high production speeds.

It was also especially surprising that the method according to the invention allows spinning high-molecular-weight polyethylene without causing the feared spinning breaks which typically occur when using the previously known methods of spinning high-molecular-weight polyethylene in the form of elastic melts or solutions. Thus, the number of melt separations, which in known methods were frequently ascribed to processes taking place inside the spinneret, is considerably reduced or completely eliminated.

The method according to the invention makes it possible to pull off the fibers at speeds as high as 4000 m/min or more. The fibers obtained exhibit such good mechanical properties that after-stretching is no longer required and sometimes is not even possible. By virtue of their properties, the fibers which can be cut to form staple fibers are especially suitable for use as technical yarns. They can be processed very well into protective clothing, for example, bulletproof vests and the like, ropes, parachutes, etc., and are also very suitable for use as staple fibers to reinforce plastics.

Although the processes that occur in the process according to the invention inside the jet and in the spinning duct are not explained in detail, it appears that the method according to the invention produces an especially advantageous molecular structure, i.e., an especially favorable molecular structure in the fibers. We can assume that in the process according to the invention, sufficient numbers of sufficiently lengthwise-oriented molecular chains are produced which simultaneously function as chain warps, that the lengthwise-oriented molecules in the laminated areas have a favorable ratio to one another, and that chain fold defects occur only to a minor extent.

The invention will now be described in greater detail with reference to the following non-limiting examples:

Comparative Example 1

A 1.5 wt. % solution of an ultra-high-molecular-weight polyethylene was prepared as follows: 48.7 g of a polymer with an intrinsic viscosity of 33.38 dl/g, measured at 135° C. in decaline, with a $M_w=5.5\times10^6$ kg/kmol and $M_n=2.5\times10^6$ kg/kmol was added to 3,200 g of paraffin oil and 16.2 g of the antioxidant 2,6-di-t-butyl-4-methylcresol and agitated at a temperature of 120° C. in a five-liter vessel. The mixture was homogenized by stirring and heated to 150° C. The stirrer was shut off as soon as the polyethylene was fully dissolved and the so-called Weisenberg effect occurred. Then the temperature was held at 150° C. for 48 hours. The solution was cooled to room temperature and a gel formed at about 130° C. The gel was fed to a spinning machine with spinnerets that had a trumpet-shaped cross section as shown in the figure. The outlet openings of the jet openings were 0.5 mm in diameter. The solution was extruded at 220° C. at a rate of 1 m/min; the fibers were quenched in air and wound up at the same speed. After extracting the paraffin oil, the resultant fibers were stretched up to a ratio of 200 at a temperature of 148° C., producing fibers with a strength of 7.0 GPa.

Comparative Example 2

The solution described in Example 1 was prepared in the same fashion; it was then processed with an extrusion rate of 100 m/min and a winding speed of 500 m/min. The resultant fibers can no longer be hot-stretched; strength after extraction of the paraffin oil with n-hexane was 0.3 GPa.

Example 3

A solution corresponding to Example 1 was spun at an extrusion rate of 100 m/min; however, by means of a cylindrical furnace, one section 20.5 cm below the outlet area of the spinneret was kept at 160° C. The fibers were pulled off at a speed of 4,000 m/min. These fibers could no longer be hot-stretched but, following extraction with paraffin oil, exhibited the following properties:

| | |
|---|---|
| Strength: | 2.3 GPa |
| Young's modulus: | 36 GPa |
| Elongation at break: | 8% |

Example 4

A spinning solution like that described in Example 3 was processed, but working at an extrusion temperature of 190° C. and a winding speed of 2,000 m/min. The strength of the extracted fibers was 1.7 GPa.

Example 5

A spinning solution was processed as in Example 3, but at an extrusion rate of 10 m/min and a winding speed of 2,000 m/min. The strength of the extracted fibers was 1.9 GPa.

Example 6

The spinning solution was processed according to Example 3, but at an extrusion rate of 5 m/min using a spinneret with spinning openings that had a diameter of 1 mm at the outlet. In contrast to Examples 1 to 4, in which a spinning duct 0.5 m long was used, in this case a spinning duct 4 m long was used. This length was necessary to allow the extruded fibers to cool sufficiently before they were wound. The winding speed was 2,000 m/min. The fibers had a strength of 1.4 GPa after extraction.

Example 7

As described in Example 1, a 3% spinning solution was produced from a polyethylene having a $M_w=4\times10^6$ and a $M_n=2\times10^5$. processing was carried out at an extrusion temperature of 190° C. and a pulling-off speed of 3,000 m/min. The strength of the extracted fibers was 0.8 GPa.

Example 8

Using a spinning solution corresponding to Example 7, the process was carried out at an extrusion temperature of 220° C. at a winding speed of 4,000 m/min. The strength of the extracted fibers was 0.8 GPa.

Example 9

A spinning solution corresponding to Example 7, but with a concentration of 5 wt. %, was extruded at 220° C., and the pulloff speed was 3,500 m/min. The strength of the extracted fibers was 0.6 GPa.

Example 10

A spinning solution was prepared similarly to Example 1 but using decaline as the solvent. The spinning material was extruded at an extrusion temperature of 180° C. at a spinning speed of 100 m/min and wound up at a 1,000 m/min. The strength of the extracted fibers was 0.9 GPa.

The examples show that, when the process is employed without the use of a heating device below the spinneret, usable strengths can only be achieved by after-stretching with heat. However, it is then necessary to work at very low extrusion rates. If higher extrusion rates are used, after-stretching is no longer possible and strengths are so low that the fibers are not usable for most applications.

Examples 3 to 10 according to the invention, on the other hand, show that it is possible to use a single-stage process without after-stretching being required, and that strengths are obtained in this manner which are twice or several times the strength obtained when working according to Example 2.

We claim:

1. A process for manufacturing polyethylene fibers by high-speed spinning of a solution of ultra-high-molecular-weight polyethylene, comprising the steps of:

extruding into a heating zone of a spinning duct a 1 to 6 wt. % solution of polyethylene with a molecular weight $M_w\geqq1\times10^6$ and a solvent at an extrusion temperature $T_E=180°-250°$ C. and at an extrusion rate $V_E=5-150$ m/min through spinnerets with jet openings, the cross section of the spinnerets decreasing towards the jet openings;

maintaining the heating zone of said spinning duct at a temperature of 100° to 250° C.;

blowing a gas on the extruded fibers below the heating zone;

pulling the fibers off at a speed $V_w\geqq500$ min;

wherein the fibers are freed from substantially all of the solvent without further stretching.

2. Process according to claim 1, wherein the polyethylene has a molecular weight $M_w\geqq3.5\times10^6$.

3. Process according to claim 1, wherein the polyethylene has a molecular non-uniformity $$U=\frac{M_w}{M_n}\leqq5$$

4. Process according to claim 3, wherein $U\leqq3$.

5. Process according to claim 1, wherein said heating zone is maintained at a temperature of 150° to 190° C.

6. Process according to claim 5, wherein said duct heating zone temperature is maintained by means of a heater.

7. Process according to claim 1, wherein the fiber is pulled off at a speed $V_w\geqq1000$ m/min.

8. Process according to claim 2, wherein the fiber is pulled off at a speed $V_w\geqq1000$ m/min.

9. Process according to claim 7, wherein the fiber is pulled off at a speed $V_4=1500-4000$ m/min.

10. Process according to claim 1, wherein the solution has a viscosity of 1 to 100 Pa/s, measured with $D=1\ s^{-1}$, at said extrusion temperature.

11. Process according to claim 2, wherein the solution has a viscosity of 1 to 100 Pa/s, measured with $D=1\ s^{-1}$, at said extrusion temperature.

12. Process according to claim 10, wherein the solvent is paraffin oil.

* * * * *

UNITED STATES PATENT AND TRADEMARK OFFICE

CERTIFICATE OF CORRECTION

PATENT NO. : 5,068,073

DATED : November 26, 1991

INVENTOR(S) : Albert J. PENNINGS et al

It is certified that error appears in the above-identified patent and that said Letters Patent is hereby corrected as shown below:

Col. 2, line 19, change "$V_r$=5" to --$V_E$=5--;

lines 61-63 change the equation

"

$$U = \frac{M_w}{M_n}$$

" to

-- $$U = \frac{\overline{M}_w}{\overline{M}_n}$$ --.

Col. 3, lines 52-54, change the equation

"

$$U = \frac{M_w}{M_n}$$

" to

-- $$U = \frac{\overline{M}_w}{\overline{M}_n}$$ --;

line 56, before "preferably" insert --should--.

Col. 4, line 22, change "Which" to --which--.

Col. 5, line 22, change "afterstretching" to --after-stretching--.

Col. 7, line 5, change "processing" to --Processing--.

UNITED STATES PATENT AND TRADEMARK OFFICE

CERTIFICATE OF CORRECTION

PATENT NO. : 5,068,073

DATED : November 26,1991

INVENTOR(S) : Albert J. PENNINGS et al

It is certified that error appears in the above-identified patent and that said Letters Patent is hereby corrected as shown below:

IN THE CLAIMS:

Col. 8, claim 3, lines 23-25, change the equation

" $U = \frac{M_w}{M_n}$ " to

-- $U = \frac{\overline{M}_w}{\overline{M}_n}$ --;

Col. 8, claim 9, line 36, change "$V_4$=1500-4000" to --$V_w$=1500-4000--.

Signed and Sealed this

Twenty-seventh Day of April, 1993

*Attest:*

MICHAEL K. KIRK

*Attesting Officer*

*Acting Commissioner of Patents and Trademarks*